US006234122B1

(12) United States Patent
Kirschbaum et al.

(10) Patent No.: US 6,234,122 B1
(45) Date of Patent: May 22, 2001

(54) METHOD FOR DRIVING AN ELECTROMAGNETIC ACTUATOR FOR OPERATING A GAS CHANGE VALVE

(75) Inventors: Frank Kirschbaum, Stuttgart; Kurt Maute, Sindelfingen; Madhukar Pandit, Kaiserslautern; Michael Virnich, Korlingen, all of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/440,656

(22) Filed: Nov. 16, 1999

(30) Foreign Application Priority Data

Nov. 16, 1998 (DE) ..... 198 52 655

(51) Int. Cl.[7] ..... F01L 9/04; F01N 1/00

(52) U.S. Cl. ..... 123/90.11; 251/129.01; 251/129.1; 251/129.16

(58) Field of Search ..... 123/90.11; 251/129.01, 251/129.09, 129.1, 129.15, 129.16

(56) References Cited

U.S. PATENT DOCUMENTS

| | | | | |
|---|---|---|---|---|
| 4,614,170 | * | 9/1986 | Pischinger et al. | 123/90.11 |
| 4,779,582 | * | 10/1988 | Lequesne | 123/90.11 |
| 4,823,825 | | 4/1989 | Büchl | 137/1 |
| 4,829,947 | * | 5/1989 | Lequesne | 123/90.11 |
| 4,848,725 | * | 7/1989 | Tibbals, Jr. | 251/129.02 |
| 5,775,276 | * | 7/1998 | Yanai et al. | 123/90.11 |
| 6,003,481 | * | 12/1999 | Pischinger et al. | 123/90.11 |
| 6,016,778 | * | 1/2000 | Koch | 123/90.11 |

FOREIGN PATENT DOCUMENTS

| | | |
|---|---|---|
| 43 30 531 A1 | 3/1995 | (DE) . |
| 195 26 683 A1 | 1/1997 | (DE) . |
| 195 30 121 A1 | 2/1997 | (DE) . |
| 195 30 798 A1 | 2/1997 | (DE) . |
| 196 31 909 A1 | 2/1997 | (DE) . |
| 197 39 840 A1 | 3/1999 | (DE) . |
| WO 98/38656 | 9/1998 | (WO) . |

* cited by examiner

*Primary Examiner*—Weilun Lo
(74) *Attorney, Agent, or Firm*—Venable; George H. Spencer; Norman N. Kunitz

(57) ABSTRACT

In the case of known electromagnetic actuators each with at least one electromagnet acting on an armature, operational fluctuations of system parameters can lead to incorrect functioning, in particular to increased wear of the actuator, undesired noise generation, and excessive power consumption. In the new method, which is preferably used for operating gas change valves in internal combustion engines, the impact velocity of the armature on the electromagnet is automatically adjusted to a preset value. For this purpose, a controlled variable that depends on a change of inductance of the electromagnet is created as a measure of the impact velocity of the armature on The electromagnet and the controlled variable is adjusted by controlling the energy supply To the electromagnet to provide a setpoint value that the controlled variable adopts at a preset value of the impact velocity of the armature on the electromagnet. This permits reliable continuous duty with the new method.

15 Claims, 2 Drawing Sheets

METHOD FOR DRIVING AN ELECTROMAGNETIC ACTUATOR FOR OPERATING A GAS CHANGE VALVE

CROSS-REFERENCE TO RELATED APPLICATION

This application claims the rights of priority of German Patent Application No. 19852655.5-33 filed Nov. 16, 1998, the subject matter of which is incorporated herein by reference.

BACKGROUND OF THE INVENTION

The present invention relates to a method for driving an electromagnetic actuator for operating a gas change valve in which the actuator has at least one electromagnet and acts via an armature on the gas change valve against the force of at least one valve spring and operates the gas change valve by movement of the armature.

Electromagnetic actuators are usually used in internal combustion engines for operating gas change valves with which the inflow and outflow of a working fluid is controlled respectively into and out of the combustion chambers of the internal combustion engine.

Such an actuator is known, for example, from DE 196 31 909 A1. This previously known actuator has two electromagnets—a closing magnet and an opening magnet—with pole surfaces situated opposite to one another and an armature that can move axially between the pole surfaces of the electromagnets and which acts on the gas change valve to be operated in opposition to the force provided by two valve springs. In non-energized electromagnets, the armature is held securely in a position of equilibrium approximately mid-way between the pole surfaces of the electromagnets due to the oppositely acting valve springs.

By alternately energizing, i.e. switching on and off, the two electromagnets, the armature and hence also the gas change valve is attracted away from the position of equilibrium by the electromagnet being energized and held securely at the pole surface of this electromagnet for the period over which current is being applied. The gas change valve is than in a closed position when the armature is located against the pole surface of the electromagnet functioning as closing magnet, and in an open position when the armature is located against the pole surface of the electromagnet functioning as opening magnet.

In the previously known actuator, the position of equilibrium of the armature is determined by measuring the inductances of the two electromagnets and by a comparison of the two measured Inductance values, and in the event of a deviation from the desired value the position of equilibrium is readjusted.

Furthermore, from U.S. Pat. No. 4,823,825 it is known that in an actuator of the type named at the outset the impact of the armature on the energized electromagnet is detected by a brief drop followed by a renewed rise in an excitation current flowing through this electromagnet. The absence of this brief drop in the excitation current indicates that a faulty function has already occurred although this cannot be avoided, it is detected immediately and therefore allows measures to be initiated To rectify the fault.

The problem is unsolved, however, of eliminating in the control the influence of operational system parameters, especially fluctuations in friction, temperature and pressure in the combustion chambers as well as changes in the viscosity of the lubricant and wear or dirtying of the actuator or gas change valve. This can result in incorrect functioning of the actuator and in particular to increased wear of the actuator, undesired noise development end increased power consumption. Reliable continuous duty of the actuator is therefore not assured.

SUMMARY OF THE INVENTION

The object of the invention is to provide a method for driving an electromagnetic actuator for operating a gas change valve in which the actuator with at least one electromagnet acts via an armature and counter to the force of at least one valve spring upon the gas change valve and operates the gas change valve by movement of the armature that makes reliable continuous duty possible.

In accordance with the invention, the object is solved by a method for driving an electromagnetic actuator for operating a gas change valve in which the actuator with at least one electromagnet acts via an armature on the gas discharge valve against the force of at least one valve spring and operates the gas change valve by movement of the armature, wherein a controlled variable ($V_{IST}$) that depends on a change in inductance of the electromagnet is created as a measure of the impact velocity of the armature on the electromagnet, and wherein the controlled variable is adjusted to a setpoint value ($V_{SOLL}$), which corresponds to a predetermined value of the impact velocity of the armature on the electromagnet, by controlling the supply of energy to the electromagnet. Advantageous variants and developments are disclosed and discussed.

The invention is based on the fact that the movement of the armature causes a change in the inductance of the electromagnet. The change in inductance of the electromagnet is therefore a measure of the armature velocity and consequently it is also a measure of the impact velocity of the armature on the electromagnet or the impact velocity of the gas change valve in a valve seat.

In accordance with the Invention, a controlled variable that depends on the change in inductance of the electromagnet is created as a measure of the impact velocity of the armature on the electromagnet. This controlled variable is varied by controlling the supply of energy to the electromagnet in such a way that the impact velocity of the armature on the electromagnet assumes a predetermined, i.e. demanded, value and is thus limited. This ensures that the armature is supplied with sufficient energy in order to move it to the electromagnet and hold it there, even if the system parameters change; furthermore the supply of energy is reduced to a necessary extent. This leads to fault-free operation and to a Iowa consumption of electrical power, less wear, lower noise development and to avoidance of rebounding of the armature or gas change valve from the electromagnet or valve seat.

In an advantageous development of the method, the controlled variable is created by measuring the rate of current decrease of an excitation current flowing through the electromagnet while the armature is moving. In a further advantageous development of the method, the variation of the inductance of the electromagnet is measured over a period of time and the velocity of the armature at the point of time when it impacts the electromagnet is derived as controlled variable from this inductance curve.

The inductance curve is obtained by measuring the inductance of the electromagnet over successive intervals of time. Advantageously, the inductance of the electromagnet is determined from the variations over time of an excitation voltage supplied to the electromagnet and of an excitation current flowing through the electromagnet. It is also advantageous to measure the resonant frequency of a LC oscillating circuit formed from the electromagnet and a capacitance or to measure the complex impedance of the electromagnet by means of a high-frequency measuring signal supplied to the electromagnet and the determination of the inductance of the electromagnet from the resonant frequency or from the complex inductance.

Preferably, the controlled variable is compared with a given setpoint value and a next closing time point of the electromagnet is specified in accordance with the result of the comparison. Consequently, the energy that must be supplied to the armature during the next operation of the gas change valve is controlled in such a way that the impact velocity of the armature on the electromagnet is adjusted to the given value.

The setpoint value of the controlled variable is equivalent to the specified value of the impact velocity of the armature on the electromagnet. It is advantageously specified as a function of system parameters, in particular as a function of the friction, the temperature, and the pressure prevailing in the combustion chamber when the gas change valve is opened. Preferably, also the closing time points of the electromagnet are specified as a function of system parameters. It has been found to be particularly advantageous to specify not only the closing time points but also the local maximum values of the excitation current flowing through the electromagnet as a function of system parameters.

In an advantageous further development of the method, control data is created from the closing time points of the electromagnet that, in the settled state, become set with various system parameters or from both these closing time points and local maximum values of the excitation current that result from the same system parameters, said control data being stored in a memory in accordance with the system parameters. If the system parameters change, the next closing time point of the electromagnet is controlled, i.e. specified, by feedforward of the stored control data corresponding to the present system parameters, and subsequently adjusted.

In the case of an actuator with two opposing electromagnets that act on the armature against the force of two valve springs, it is sufficient to measure the impact velocity of the armature on one of the two electromagnets on the basis of the change in inductance of this electromagnet, because, when the position of equilibrium is set correctly, the armature impacts both electromagnets with essentially the same velocity. Advantageously, the impact velocity of the armature is set in the same way on both electromagnets, because it is then no longer necessary to precisely maintain the position of equilibrium of the armature.

DESCRIPTION OF THE PREFERRED EMBODIMENTS

The invention will now be described In more detail an the basis of an embodiment example with reference to the Figures.

Figure 1:
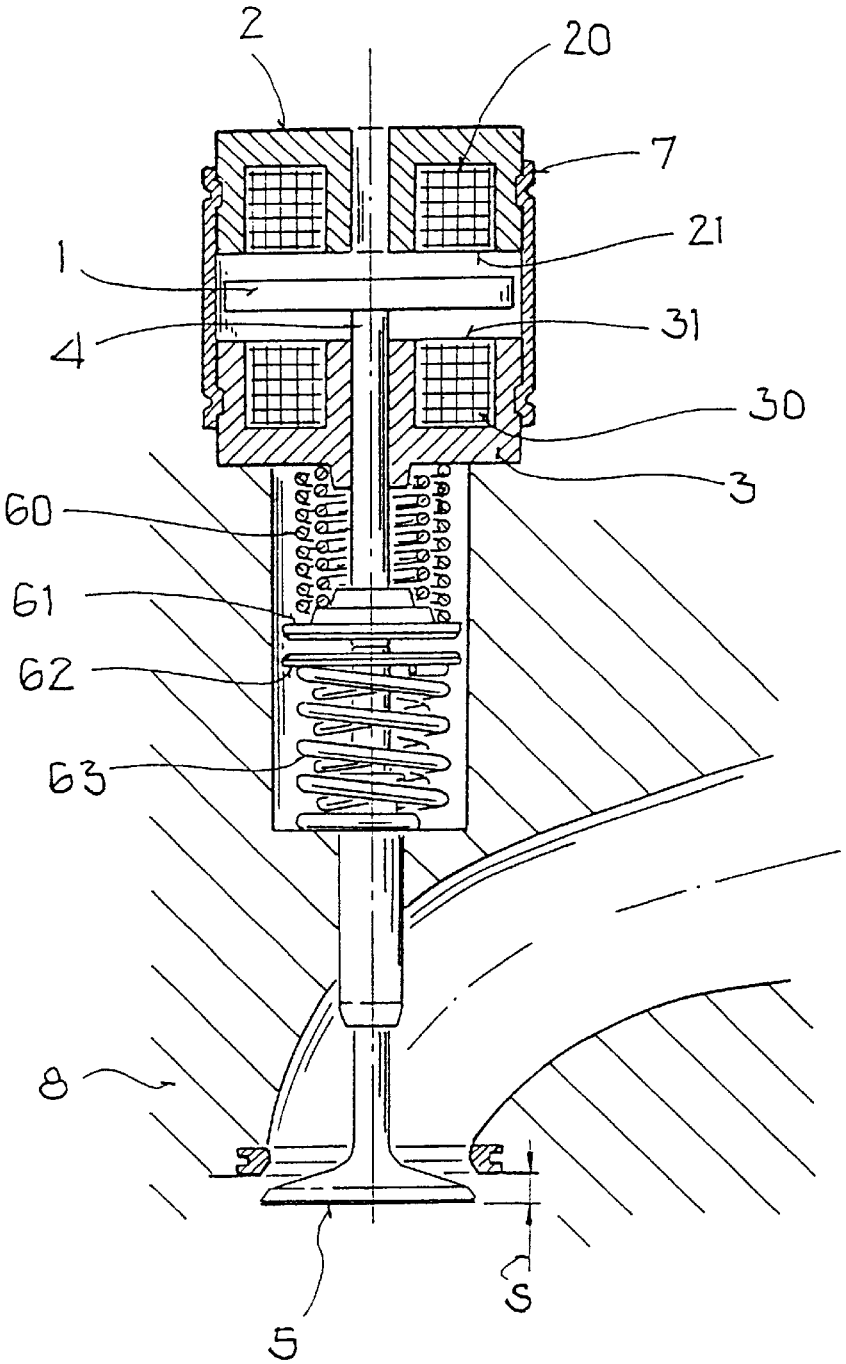
FIG. 1 is an electromagnetic actuator for operating a gas change valve.

As shown in FIG. 1, the actuator comprises a plunger 4 which interacts with a gas change valve 5, an armature 1 attached to the plunger 4 transversely to the plunger longitudinal axis, an electromagnet 2 that sets as a closing magnet, and another electromagnet 3 that acts a an opening magnet and which is arranged at a distance from the closing magnet 2 in the direction of the plunger longitudinal axis. The electromagnets 2, 3 are joined together by means of a housing part 7; they each have an operating coil 20 and 30 respectively and pole surfaces 21 and 31 respectively opposing each other between which the armature 1 is moved to and fro by alternately energizing the two electromagnets 2, 3, i.e. by supplying current to the operating coils 20 and 30 respectively. Two oppositely acting valve springs 60, 63, which are arranged between the opening magnet 3 and the gas change valve 5 and attached by means of two spring plates 61, 62 to the actuator or to the cylinder head part 8 of the internal combustion engine cause the armature 1 to be held in a position of equilibrium approximately in the middle between the pole surfaces 21, 31 of the electromagnets 2, 3 when no current is flowing through the operating coils 20, 30.

To start the actuator, one of the electromagnets 2, 3 is energized by applying an excitation voltage to the corresponding operating coil 20 or 30 respectively, i.e. it is switched on, or a build-up routine is initiated through which the armature 1 is initially put into a state of oscillation by alternately energizing the electromagnets 2, 3 in order to make contact with the pole surface 21 of the closing magnet 2 or the pole surface 31 of the opening magnet 3 after a transient period.

When the gas change valve 5 is closed, the armature 1 is in contact with the pole surface 21 of the closing magnet 2 and It is held in this position as long as the closing magnet 2 is energized. In order to open the gas change valve 5, the closing magnet 2 is switched off and then the opening magnet 3 is switched on. The valve spring 60 that acts in the opening direction accelerates the armature 1 beyond the position of equilibrium. Due to the opening magnet 3, which is now energized, additional kinetic energy is supplied to the armature 1 so that this reaches the pole surface 31 of the opening magnet 3 in spite of any frictional losses and is held there until the opening magnet 3 is switched off. To again close the gas change valve 5, the opening magnet 3 is switched off and the closing magnet 2 is then switched on again. This causes the armature 1 to move towards the pole surface 21 of the closing magnet 2 and it is held there.

The distance of the armature 1 to the particular electromagnet 2, 3 determines the inductance of this electromagnet 2 or 3 respectively; the velocity of the armature 1 can thus be established from the change in inductance of the electromagnets 2, 3.

In the following, only The means of automatically controlling the impact velocity of the armature 1 on the closing magnet 2 will be described the impact velocity of the armature 1 on the opening magnet 3 is controlled in the same way.

Figure 2:
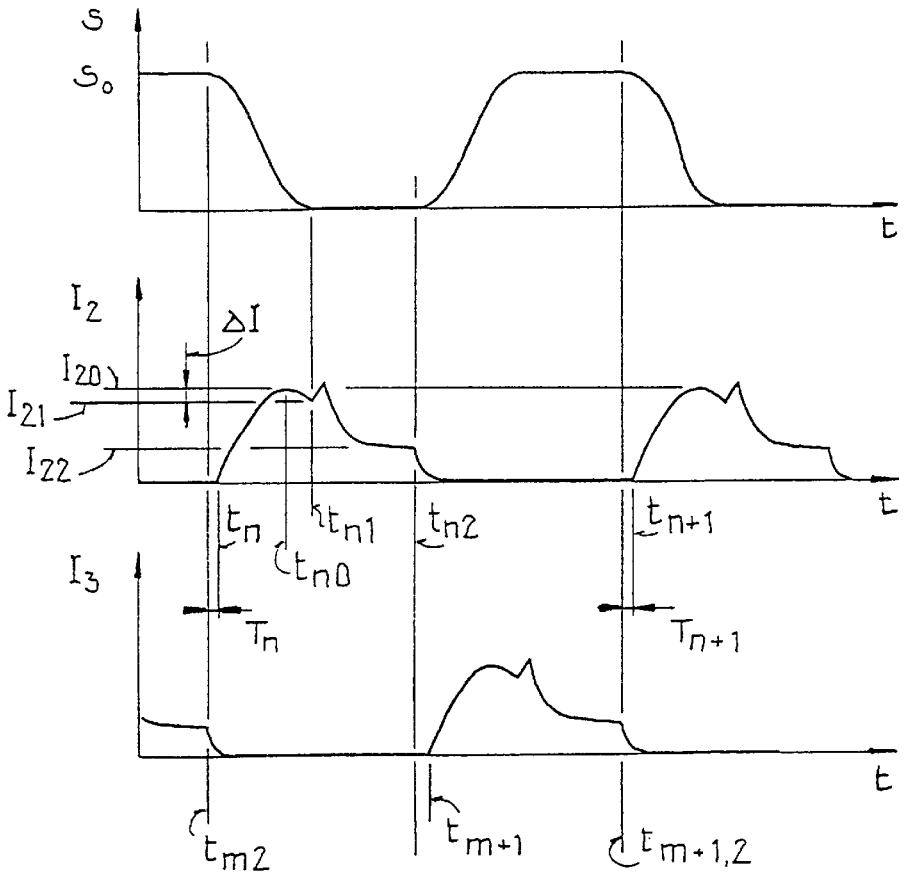
FIG. 2 is a time chart of a valve stroke and two excitation currents flowing through respectively one of two electromagnets of the actuator.

As shown in FIG. 2, the gas change valve 5 is in an open position $s_0$ up until time $t_{m2}$, i.e. the armature 1 is in contact with the pole surface 31 of the opening magnet 3. At time $t_{m2}$, the opening magnet 3 is switched off and then at time $t_n$ the closing magnet 2 is switched on. The armature 1 thus releases itself from the opening magnet 3 and moves towards the closing magnet 2, causing the valve lift s to reduce. At the same time, the excitation current $I_3$ of the opening magnet 3 drops to zero; the excitation current $I_2$ of the closing magnet 2, however, rises from zero to a local maximum value $I_{20}$ which it reaches at time two before falling to a local minimum value $I_{21}$ which it reaches at time $t_{n1}$ when the armature 1 impacts the closing magnet 2. The excitation current $I_2$ then rises steeply and subsequently falls to a holding value $I_{22}$ which is predetermined, for instance, by pulse width modulation of the excitation voltage supplied to the operating coil 21.

The speed at which the excitation current $I_2$ reduces in the time interval $t_{n0} \ldots t_{n1}$ depends on the armature velocity; the current decrease ΔI is greater for high armature velocities than for low armature velocities. The origin of this current decrease ΔI can be explained with the following equation:

$$u(t) = i(t) \cdot R_{Cu} + \frac{d\Psi}{dt},$$

where u(t) stands for the excitation voltage supplied To the closing magnet 2, i(t) for the excitation current $I_2$ of the closing magnet 2 that flows through the operating coil 20 as a result Of The excitation voltage u(t), $R_{Cu}$ for the ohmic resistance of the operating coil 20, and dΨ/dt for the induced negative field voltage, i.e. for the derivation in terms of time of the linked magnetic flux Ψ(t). For the letter, the relationship Ψ(t)=i(t)·L(t) applies, where L(t) stands for the inductance of the closing magnet 2, so that the following equation is obtained for the induced negative field voltage dΨ/dt:

$$\frac{d\Psi}{dt} = \frac{d\,i(t)}{dt} \cdot L(t) + i(t) \cdot \frac{dL}{dx} \cdot \frac{dx}{dt}.$$

The travel of the armature 1 with respect to the dosing magnet 2 is designated x, i.e. the distance between the pole surface 21 of the dosing magnet 2 and the armature 1. A movement of the armature 1 in the direction of the closing magnet 2 thus supplies a positive contribution to the induced negative field voltage dΨ/dt which becomes greater as the absolute value of the change of distance x with respect to time dx/dt, i.e. the armature velocity, increases. Because the excitation voltage u(t) is kept constant during the motion phase of the armature 1, the excitation current i(t) drops after reaching the local maximum $I_{20}$ at a rate that depends on the armature velocity dx/dt. The rate of current decrease ΔI of the excitation current $I_2$ is therefore a function of the impact velocity of the armature 1 or the closing magnet 2. This can be established in various ways: one possibility is to sample the excitation current $I_2$, differentiate numerically and to determine the smallest of the values obtained in this way; it can, however, also be established approximately by detecting the local maximum $I_{20}$ and the following local minimum $I_{21}$ and by calculating the slope of a straight line passing through the local maximum $I_{20}$ and through the local minimum $I_{21}$.

In order to control the impact velocity of the armature 1 on the closing magnet 2, a controlled variable $v_{IST}$ is formed corresponding to the rate of current decrease ΔI of the excitation current $I_2$, the controlled variable $v_{IST}$ is compared with a setpoint value $v_{SOLL}$ and a next closing time point of the closing magnet 2 is preset in accordance with the result of comparison. This is an iterative learning control process that functions in accordance with the following algorithm:

$$T_{n+1}=T_n+k\cdot(v_{SOLL}-v_{IST}).$$

$T_n$ and $T_{n-1}$ represent the closing time points of the closing magnet 2 in successive cycles; they are always specified with respect to a defined reference time point of the relevant cycle. A cycle signifies here the sequence of events between two successive opening or closing operations of the gas change valve 5. Furthermore, n is a cycle number, k a proportionality factor, and $v_{SOLL}-v_{IST}$ is the result of the comparison between the controlled variable $v_{IST}$ and the setpoint $v_{SOLL}$.

In the present example, the reference time points of the respective cycles are the break times $T_{m2}$, $t_{m+1,2}$ of the opening magnet 3, so that with the designations used in FIG. 2 the following applies:

$$T_n=t_n-t_{m2}$$

$$T_{n+1}=t_{n+1}-t_{m+1,2}.$$

The setpoint $v_{SOLL}$ of the controlled variable $v_{IST}$ is that value of the controlled variable $v_{IST}$ which at a given, i.e., demanded, value of the impact velocity of the armature 1 on the closing magnet 2 is measured. It can very in accordance with different system parameters, in particular according to the friction of the gas change valve 5 and the moving parts of the actuator, the temperature of the lubricant, the pressure in the combustion chamber at the time the gas change valve 5 opens, and the closing time points of the electromagnets 2, 3. The setpoint $v_{SOLL}$ is therefore advantageously predetermined dynamically in accordance with these system parameters that are determined by means of suitable sensors or from characteristics fields.

By shifting the closing time points $T_n$, $T_{n+1}$ of the closing magnet 2 step by step, more or less kinetic energy is supplied to the armature 1 with each cycle, thus causing the impact velocity of the armature 1 on the closing magnet 2 to increase or decrease respectively, The current decrease ΔI is accordingly greater or less from cycle to cycle. Learning from cycle to cycle is thus assured.

The application of this algorithm calls for a cyclic mode of operation with repetitive process sequences, although these need not take place strictly periodically, Accordingly, the algorithm is applied only when the system parameters (friction, temperature, pressure in the combustion chamber) do not vary, or vary only slightly, from cycle to cycle. In phases where the cycles vary greatly, it is advantageous to use feedforward control, i.e. the system parameters are established and the closing time points $T_{n+1}$ for the following cycles are preset, initially in accordance with the system parameters, and subsequently corrected. If the impact velocity has settled to the preset value in a phase where the cycles do not vary, the closing time point $T_{n+1}$ can be stored according to the system parameters as control data in a storage unit and can be used for feedforward control for the same system parameters. In this way, an adaptive feedforward control is provided.

In the present example, the effect of the change in inductance of the electromagnets 2 and 3 on the excitation current $I_2$ and $I_3$ is evaluated. Since there is a functional relationship between the motion curve of the armature 1 and the inductance curve of the electromagnets 2, 3 that can be readily established, for instance from a suits of measurements, the impact velocity of the armature 1 on the electromagnets 2, 3 can also be controlled by establishing the inductance curve of the relevant electromagnet 2 or 3, determining from this the motion curve of the armature 1 and establishing from this motion curve the velocity of the armature 1 at the time of impact on the respective electromagnet 2 or 3 and providing it as controlled variable $v_{IST}$.

Various possibilities will be demonstrated below for establishing the inductance of the closing magnet 2; the inductance of the opening magnet 3 can of course be established in the same way.

As already explained, the following equation applies for the excitation, voltage u(t) of closing magnet 2:

$$u(t) = i(t) \cdot R_{Cu} + \frac{d\Psi}{dt}.$$

After integrating with respect to time, one obtains from this the linked magnetic flux:

$$\Psi(t) = \int_0^t (u(\tau) \cdot i(\tau) \cdot R_{Cu})\, d\tau + C.$$

With $\Psi(t)=l(t)-L(t)$ and the boundary condition $\Psi(0)=C=0$ the following therefore results for the inductance:

$$L(t) = \frac{\int_0^t (u(\tau) - i(\tau) \cdot R_{Cu})\, d\tau}{i(t)}$$

for l(t)=0. The inductance curve L(t) of the closing magnet 2 can thus be calculated from the time curves of the excitation voltage u(t) and the excitation current i(t).

Moreover, the inductance curve L(t) of the closing magnet 2 can also be established by measuring the resonant frequency of a LC oscillating circuit made up of a capacitor and the closing magnet 2. The mean resonant frequency is selected so high here through the choice of capacitor that the movement of the armature 1 is resolved with sufficient accuracy and the armature position changes only to a minimum extent over one period of oscillation For example, for a motion time of the armature 1 of approx. 3.5 ms and a mean resonant frequency of around 14 kHz, one obtains 50 oscillation periods and thus 50 values for the armature position with which the movement of the armature 1 can be resolved with sufficient accuracy for a valve lift of approx. 7 mm.

The inductance curve of the closing magnet 2 can also be established by measuring its complex inductance For this purpose, a high-frequency measuring voltage is overlaid on the excitation voltage u(t) supplied to the closing magnet 2 and that component of the excitation current i(t) due to the measuring voltage is detected from its frequency and evaluated in terms of absolute value and phase angle. The relationship resulting from the measuring voltage and the component of the excitation current corresponding to the measuring voltage yields a complex number—that of a complex inductance of the electromagnet made up of an ohmic component and an imaginary component—from the imaginary component of which the momentary inductance of the closing magnet 2 is derived.

What is claimed is:

1. Method for driving an electromagnetic actuator for operating a gas change valve (5) in which the actuator with at least one electromagnet (2, 3) acts via an armature (1) on the gas change valve (5) against the force of at least one valve spring (60, 63) and operates said gas change valve (5) by movement of the armature (1), wherein a controlled variable ($v_{IST}$) that depends on a change in inductance of the electromagnet (2, 3) is created as a measure of the impact velocity of the armature (1) on the electromagnet (2, 3), wherein the controlled variable is adjusted to a setpoint value ($v_{SOLL}$) which corresponds to a predetermined value of the impact velocity of the armature (1) on the electromagnet (2, 3), by controlling the supply of energy to the electromagnet (2, 3), wherein the energy supply to the electromagnet (2, 3) is controlled by comparing the controlled variable ($v_{IST}$) to the setpoint value ($v_{SOLL}$) and by presetting a next closing time point ($Tn_{n+1}$)I) of the electromagnet (2, 3) in accordance with the result of the comparison, wherein the closing time points ($T_n$, $T_{n+1}$) of the electromagnet (2, 3) are preset in accordance with system parameters, wherein control data is created from the closing time points ($T_n$) of the electromagnet (2, 3) that become set for various system parameters, said control data being stored in a memory in accordance with the system parameters, and wherein when the system parameters change, the next closing time point ($T_{n+1}$) of the electromagnet (2, 3) is obtained by feedforward control in accordance with the stored control data corresponding to the momentary system parameters.

2. Method for driving an electrometric actuator for operating a gas change valve (5) in which the actuator with at least one electromagnet (2, 3) acts via an armature (1) on the gas change valve (5) against the force of at least one valve spring (60, 63) and operates said gas change valve (5) by movement of the armature (1), wherein a controlled variable ($v_{IST}$) that depends on a change in inductance of the electromagnet (2, 3) is created as a measure of the impact velocity of the armature (1) on the electromagnet (2, 3), wherein the controlled variable is adjusted to a setpoint ($v_{SOLL}$) which corresponds to a predetermined value of the impact velocity of the armature (1) on the electromagnet (2, 3), by controlling the supply of energy to the electromagnet (2, 3), and wherein the rate of change is established of a current decrease (ΔI) of an excitation current ($I_2$, $I_3$) flowing through the electromagnet while the armature is in motion in order to create the controlled variable ($V_{IST}$).

3. Method for driving an electromagnetic actuator for operating a gas change valve (5) in which the actuator with at least one electromagnet (2, 3) acts via an armature (1) on the gas change valve (5) against the force of at least one valve spring (60, 63) and operates said gas change valve (5) by movement of the armature (1), wherein a controlled variable ($v_{IST}$) that depends on a change in inductance of the electromagnet (2, 3) is created as a measure of the impact velocity of armature (1) on the electromagnet (2, 3), wherein the controlled variable is adjusted to a setpoint value ($v_{SOLL}$), which corresponds to a predetermined value of the impact velocity of the armature (1) on the electromagnet (2, 3), by controlling the supply of energy to the electromagnet (2, 3), and wherein the time curve of the inductance of the electromagnet (2, 3) is established in order to create the controlled variable ($V_{IST}$).

4. Method in accordance with claim 3, wherein the time curve of the inductance of the electromagnet (2, 3) is established from the time curve of an excitation voltage (u(t)) supplied to the electromagnet (2, 3) and from the time curve of an excitation current (i(t)) flowing through the electromagnet (2, 3).

5. Method in accordance with claim 3, wherein the time curve of the inductance of the electromagnet (2, 3) is established from the curve of the resonant frequency of a LC oscillating circuit made up of the electromagnet (2, 3) and a capacitance.

6. Method in accordance with claim 3, wherein the time curve of the inductance of the electromagnet (2, 3) Is established from the curve of a complex inductance of the electromagnet (2, 3) measured by means of a high-frequency measuring signal.

7. Method in accordance with claim 2, wherein the energy supply to the electromagnet (2, 3) is controlled by comparing the controlled variable ($v_{IST}$) with the setpoint value ($v_{SOLL}$) and by presetting a next closing time point ($T_{n+}$) of the electromagnet (2, 3) in accordance with the result of comparison.

8. Method in accordance with claim 7, wherein the setpoint value ($v_{SOLL}$) is preset for the controlled variable ($v_{IST}$) in accordance with system parameters.

9. Method in accordance with claim 7, wherein the closing time points ($T_n$, $T_{n+1}$) of the electromagnet (2, 3) are preset in accordance with system parameters.

10. Method in accordance with claim 9, wherein a next local maximum value ($I_{20}$) of the excitation current ($I_2$, $I_3$) is preset in accordance with system parameters.

11. Method in accordance with claim 9, wherein control data is created from the closing time points ($T_n$) of the electromagnet (2, 3) that become set with various system parameters, said control data being stored in a memory in accordance with the system parameters, and wherein, when the system parameters change, the next closing time point ($T_{n+1}$) of the electromagnet (2, 3) is obtained by feedforward control in accordance with the stored control data corresponding to the momentary system parameters.

12. Method in accordance with claim 11, wherein The control data is created from the local maximum values ($I_{20}$) of the excitation current ($I_2$, $I_3$) resulting from the various system parameters.

13. Method in accordance with claim 2, wherein the actuator with two oppositely located electromagnets (2, 3) sets on the armature (1) against the force of two valve springs (60, 63).

14. Method in accordance with claim 13, wherein the impact velocities of the armature (1) on the two electromagnets (2, 3) are each controlled in the some way.

15. Method according to claim 1, wherein the control data is created from the local maximum values ($i_{20}$) of the excitation current ($I_2$, $I_3$) resulting from various system parameters.

* * * * *